US010107502B2

(12) United States Patent
Mueller et al.

(10) Patent No.: US 10,107,502 B2
(45) Date of Patent: Oct. 23, 2018

(54) MULTI-FUNCTION OUTDOOR TABLE WITH MOVEABLE TABLETOP USED IN MULTIPLE POSITIONS

(71) Applicant: Plank and Hide, Cincinnati, OH (US)

(72) Inventors: Erik Mueller, Loveland, OH (US); James Postell, Cincinnati, OH (US)

(73) Assignee: Plank and Hide, Cincinnati, OH (US)

( * ) Notice: Subject to any disclaimer, the term of this patent is extended or adjusted under 35 U.S.C. 154(b) by 140 days.

(21) Appl. No.: 15/222,235

(22) Filed: Jul. 28, 2016

(65) Prior Publication Data

US 2017/0030584 A1 Feb. 2, 2017

Related U.S. Application Data

(60) Provisional application No. 62/197,728, filed on Jul. 28, 2015.

(51) Int. Cl.

| | |
|---|---|
| ***A47B 13/08*** | (2006.01) |
| ***F24C 1/16*** | (2006.01) |
| ***A47B 37/04*** | (2006.01) |
| ***A47B 1/10*** | (2006.01) |

(52) U.S. Cl.

CPC ..... *F24C 1/16* (2013.01); *A47B 1/10* (2013.01); *A47B 13/081* (2013.01); *A47B 37/04* (2013.01)

(58) Field of Classification Search

USPC ..... 126/21 R

See application file for complete search history.

(56) References Cited

U.S. PATENT DOCUMENTS

| | | | | |
|---|---|---|---|---|
| 2,476,542 A | | 7/1949 | Gauss | |
| 2,766,088 A | * | 10/1956 | Jackson | A47B 9/18 108/138 |
| 3,221,137 A | * | 11/1965 | Madden | A47B 31/001 219/218 |
| 3,688,705 A | * | 9/1972 | Barabas | A47B 1/00 108/145 |
| 4,194,452 A | * | 3/1980 | Crowther | A47B 9/00 108/138 |
| D439,446 S | | 3/2001 | Harrison | |

(Continued)

FOREIGN PATENT DOCUMENTS

| | | |
|---|---|---|
| DE | 102010011575 A1 | 9/2011 |
| FR | 2643978 A1 | 9/1990 |

(Continued)

*Primary Examiner* — Avinash Savani

(74) *Attorney, Agent, or Firm* — Wood Herron & Evans LLP

(57) ABSTRACT

A multi-function outdoor patio table is described, the table including a base surrounding a contained space and a tabletop coupled to the base by a movement assembly. The tabletop is moveable relative to the base between open and closed positions to provide selective access to a functional/storage device within the base, such as a fire pit or an ice bucket. The movement assembly includes a slide rail assembly, a pivot linkage assembly, or the like such that a tabletop surface defined by the tabletop is disposed in a substantially horizontal orientation at both of the open and closed positions and also during movement of the tabletop between the open and closed positions. Thus, the tabletop surface can continue to be used in all configurations of the multi-function outdoor patio table.

17 Claims, 9 Drawing Sheets

(56) References Cited

U.S. PATENT DOCUMENTS

| | | | | |
|---|---|---|---|---|
| 6,997,111 | B2 | 2/2006 | Giegerich | |
| 7,007,813 | B2 | 3/2006 | Yang | |
| D596,892 | S | 7/2009 | Vanderminden | |
| 8,166,893 | B2 | 5/2012 | Davis | |
| 8,561,602 | B2 | 10/2013 | Andors et al. | |
| 2002/0078865 | A1* | 6/2002 | Kuvshinikov | A47B 46/00 108/143 |
| 2006/0054160 | A1* | 3/2006 | Borowske | F24B 3/00 126/512 |
| 2013/0081609 | A1 | 4/2013 | Dhuper et al. | |
| 2013/0160679 | A1 | 6/2013 | Federici et al. | |
| 2013/0239943 | A1 | 9/2013 | James | |

FOREIGN PATENT DOCUMENTS

| | | | |
|---|---|---|---|
| JP | 2006105470 | A | 4/2006 |
| RU | 2082064 | C1 | 6/1997 |

* cited by examiner

MULTI-FUNCTION OUTDOOR TABLE WITH MOVEABLE TABLETOP USED IN MULTIPLE POSITIONS

CROSS-REFERENCE TO RELATED APPLICATION

This application claims priority to U.S. Provisional Application Ser. No. 62/197,728, filed Jul. 28, 2015. This prior application is incorporated herein by reference, in its entirety.

TECHNICAL FIELD

The present invention relates generally to furniture configured for use outdoors. More particularly, the present invention relates to an outdoor patio table with a moveable tabletop and functional/storage elements stored within a base of the table.

BACKGROUND

Portable fire pits have become increasingly popular. Such fire pits allow users to cleanly and safely enjoy the pleasures of a fire on patios, porches and other areas where containing a fire had proved difficult and dangerous. However, incorporating a fire pit as a part of patio furniture presents users with issues when it comes to adequate space for drinks, containers, bowls, and the like. Furthermore, the fire pit typically takes up a significant amount of space in the space-limited settings of patios and decks, which makes it difficult to provide additional tables and the like for holding foodstuffs and other service items.

Some conventional designs have been developed where a fire pit is recessed below a tabletop surface, and the tabletop is wholly or partially removed to access the fire pit. Typically, this conventional outdoor patio furniture, such as a table containing a fire bowl or fire pit, has a portion of the tabletop removed in order to allow the user to see the fire, and for adequate ventilation of the fire. Thus, even if the fire bowl is recessed, the area of the tabletop that is removed to uncover or accommodate the fire bowl is an area that is lost to use as a traditional tabletop while the fire pit is functioning. This can quickly turn into an inconvenience if several people are trying to use the tabletop at the same time. Further, drinks or other service items placed on the surrounding lip of the fire pit will quickly heat up due to the fire, and these items may produce an unwanted combustion risk which can potentially spread fire beyond the fire pit.

Some tables containing recessed fire pits are equipped with a flat plate, or covering, designed to be placed over just the portion of the table surface which includes the recessed fire bowl. Use of such a plate or covering will allow the area of the recessed fire bowl to be used as a traditional tabletop. However, both the covering and the fire bowl cannot be used at the same time. This presents the user with a decision: enjoy a fire or enjoy sufficient tabletop space. Furthermore, even when the flat plate or covering is removed, some of the remaining portion of the tabletop cannot actually be used as a result of being too close to the operating fire pit.

Another issue faced in connection with the loss of tabletop space is the problem of limiting the size of the fire bowl (as some designs have reduced the size of the fire bowl to try and address the concerns with other conventional designs described above). As noted above, any area devoted to a fire bowl typically means area not available as tabletop space. Hence, the user is again forced to a decision. This time, the decision is between a robust, vibrant, and aesthetically pleasing fire experience, and adequate tabletop space. However, by forcing the user into making such a choice, the conventional outdoor patio tables with integrated fire pits (or other storage/functional elements such as integrated bowls or ice buckets) do not provide the multi-functionality or space efficiency which is highly desirable in the outdoor patio or deck context.

A need exists, therefore, for an outdoor patio table that allows a user to maximize the space on a tabletop surface that remains available in a table designed for multi-functional use.

SUMMARY

The multi-function outdoor patio table and other features of the invention disclosed herein overcome the foregoing and other shortcomings and drawbacks of conventional designs. To this end, one embodiment of the outdoor patio table includes a base, a tabletop, and a functional/storage device. The base includes a top panel, a base panel, and sidewalls extending between the top panel and the base panel, the base surrounding a contained space. The top panel has an aperture communicating with the contained space. The tabletop is coupled to the base proximate the top panel by a movement assembly. As a result of this coupling, the tabletop is moveable between an open position and a closed position relative to the base, and the tabletop is at least partially made of a weather resistant material. The functional/storage device may be defined by an ice bucket or a fire pit, and this device is revealed for access and use when the tabletop is moved to the open position. The tabletop defines a tabletop surface for supporting various items, and the movement assembly is arranged such that the tabletop surface is disposed in a substantially horizontal orientation at both of the open and closed positions, thereby enabling support of the various items regardless of table configuration. Advantageously, this allows for full use of the tabletop surface both when the functional/storage device is being used, and also when the table is configured as simply a table.

The outdoor patio table includes various additional features depending on the embodiment. For example, the movement assembly is defined by a pivot linkage assembly which moves the tabletop in an arc-shaped path between open and closed positions, or is alternatively defined by a slide rail assembly enabling linear movement between the open and closed positions. The tabletop may be defined by a unitary member that moves to a position cantilevered over one of the sidewalls of the base in the open position, or it may be defined by a bifurcated member having first and second tabletop segments that move in opposite directions to be cantilevered on opposite sides of the table in the open position. The tabletop may be formed from aluminum, which is weather resistant and fire resistant such that the tabletop can snuff out any remaining flames when the functional/storage device is a fire pit. When a fire pit is provided, a switch may also detect whether the tabletop is in the closed position, such that fuel supply to the burner element of the fire pit is shut off whenever the tabletop is in the closed position (for safety reasons). A control panel is also provided along one of the sidewalls to allow the user to control the fire pit in those embodiments.

In other embodiments, the functional/storage device is an ice bucket and/or a plurality of bowls configured to hold different items. For an ice bucket embodiment, the bucket may include a drain line and a stopper near the bottom end thereof to allow for draining of melted ice from the ice bucket. Alternatively, the ice bucket and/or bowls can be removable for cleaning when necessary. On the contrary, the tabletop is non-removably coupled to the base such that separate pieces do not need to be managed, and such that the movement assembly remains configured to retain the tabletop surface in the substantially horizontal orientation in all configurations of the outdoor patio table. Accordingly, users may take full advantage of the tabletop surface at all times, allowing for multiple functionalities and space-savings in the deck or patio context.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
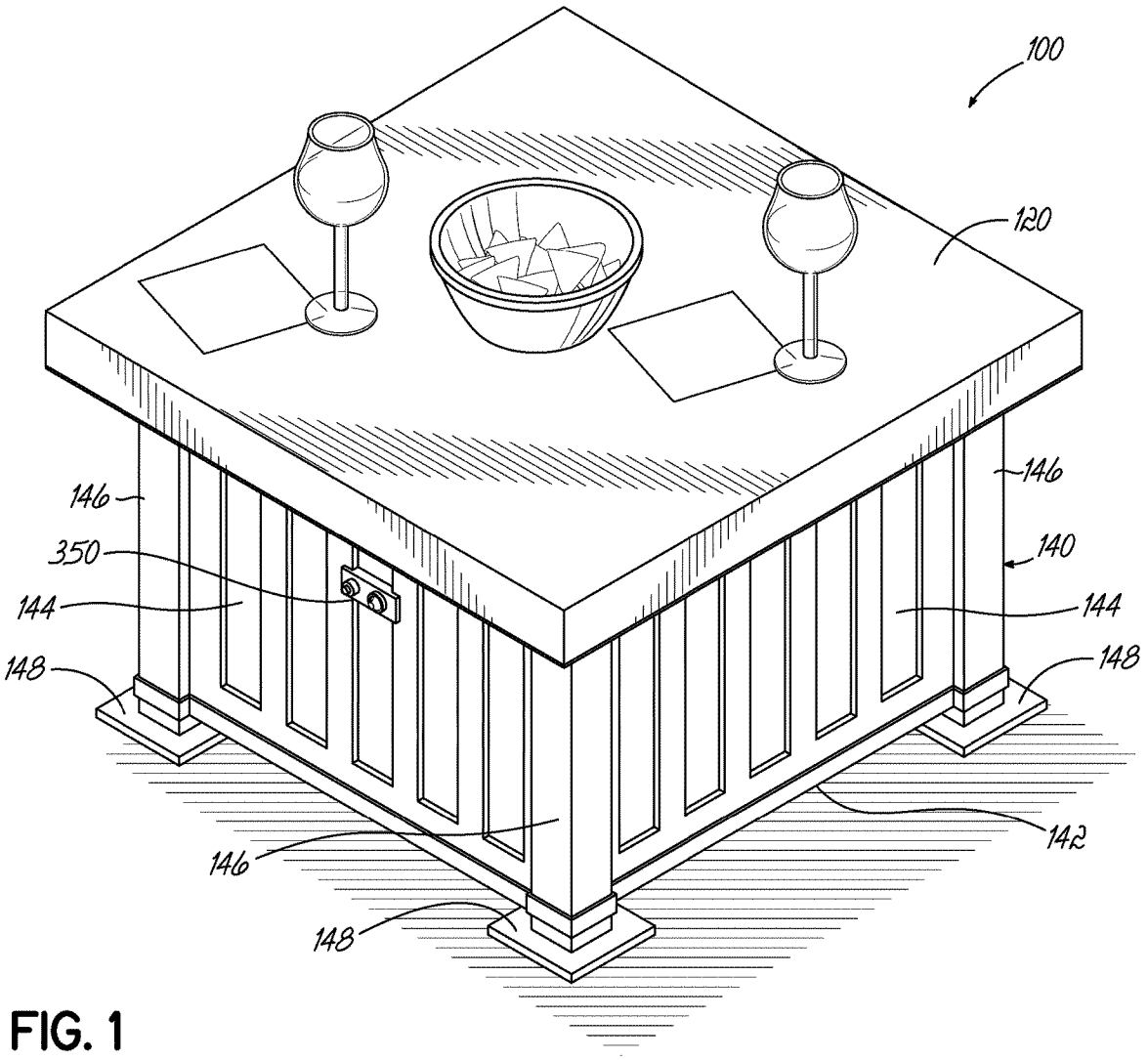
FIG. 1 is a perspective view of an outdoor patio table in accordance with an embodiment of the invention, showing a tabletop of the table in a closed position and various foodstuffs on a tabletop surface of the tabletop.
Figure 2:
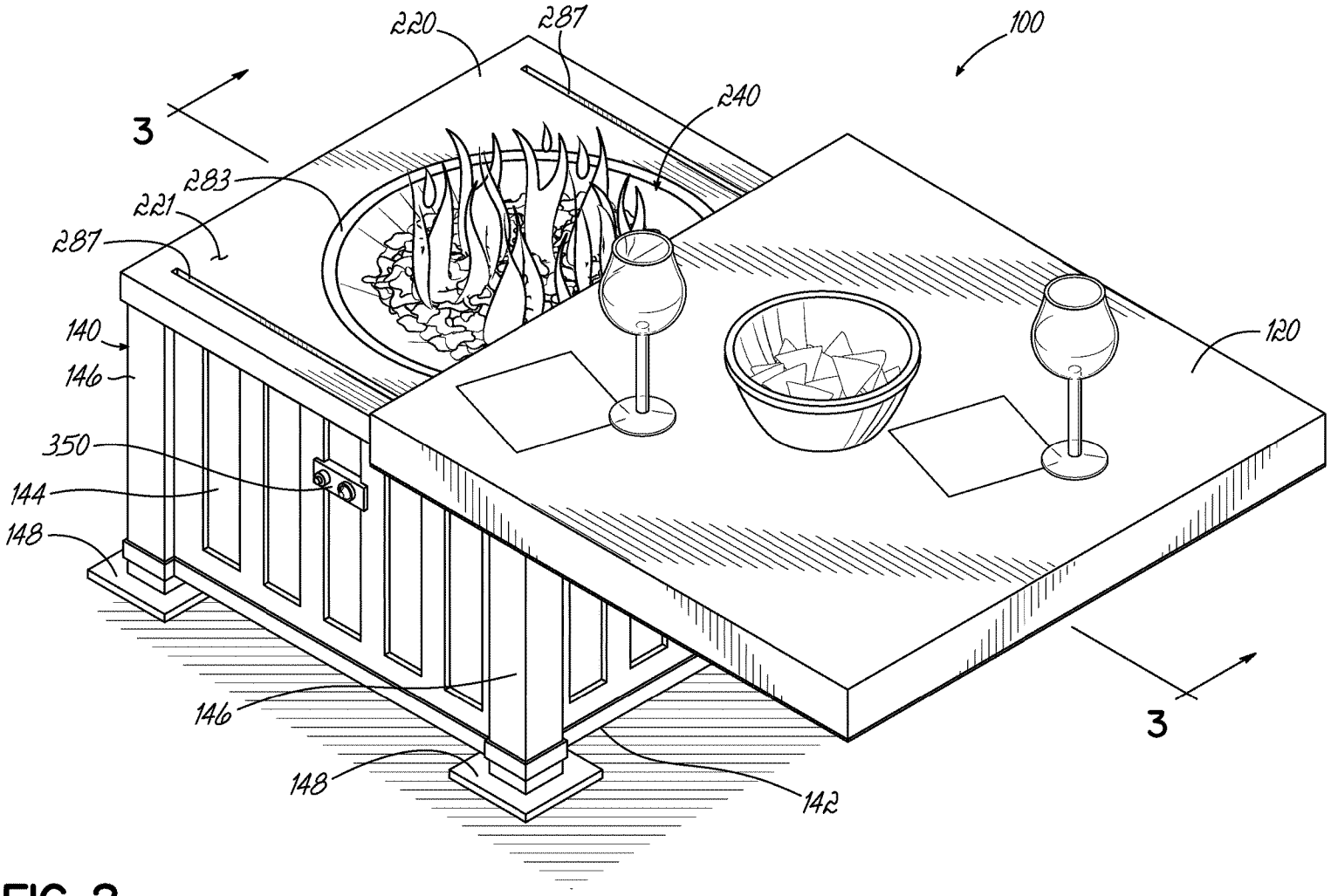
FIG. 2 is a perspective view of the outdoor patio table of FIG. 1, with the tabletop moved to an open position to reveal a fire pit located within a base of the table and a sliding rail structure used to move the tabletop between open and closed positions, wherein the tabletop remains substantially horizontal in this open position such that the various foodstuffs can continue to be retained on the tabletop surface.
Figure 3:
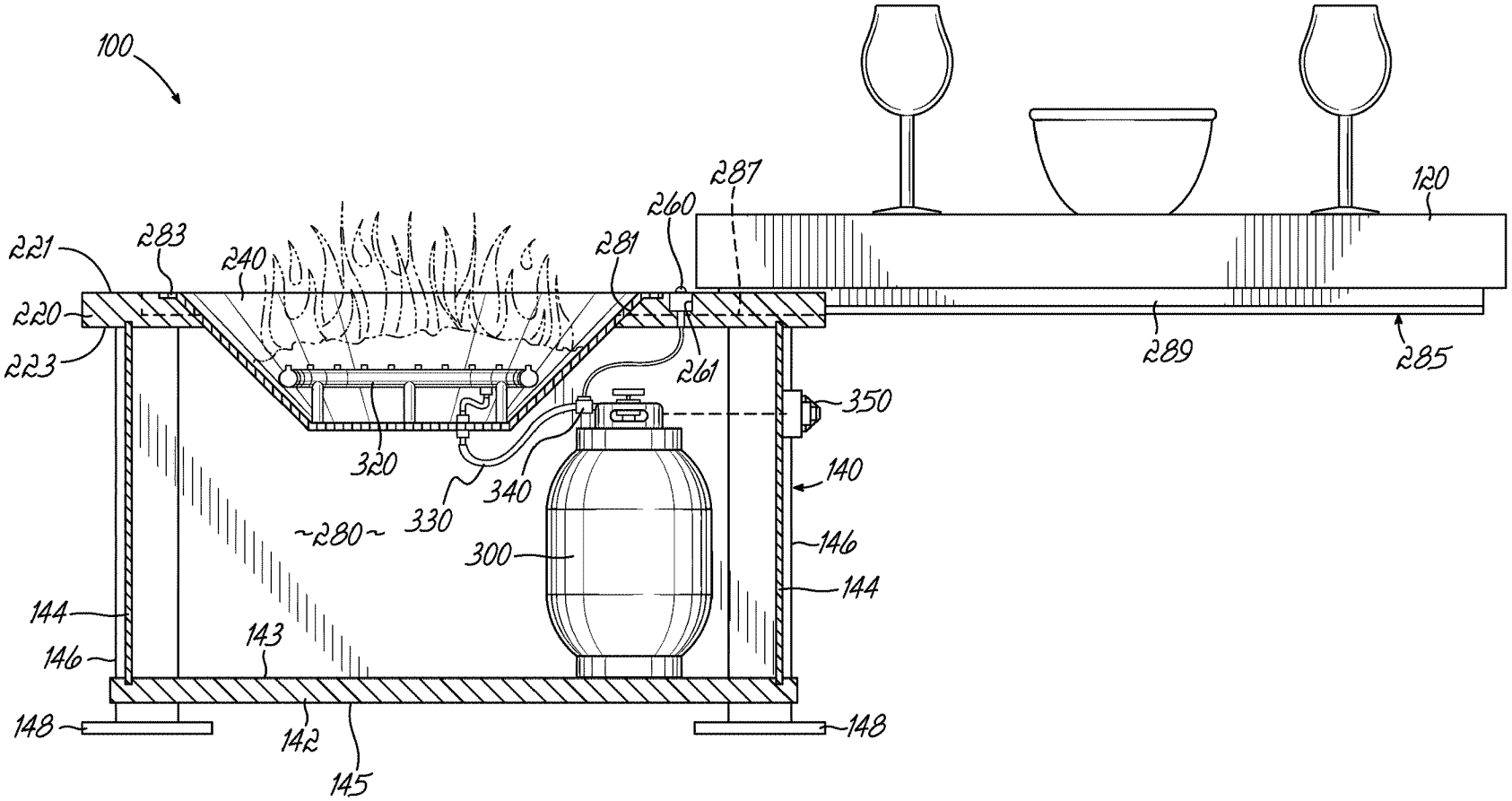
FIG. 3 is a cross-sectional front view of the table of FIG. 2, taken along line 3-3, to reveal additional internal features of the fire pit and table.

With initial reference to FIGS. 1 through 3, illustrated is a perspective view of one embodiment of an outdoor patio table 100 of the present invention, referred to hereinafter as a fire bowl table 100. Fire bowl table 100 includes a tabletop 120, moveable between a closed position (FIG. 1) and an open position (FIG. 2). In addition to tabletop 120, the fire bowl table 100 includes a base 140 configured to act as a support structure for the tabletop 120. The tabletop 120 of this and other embodiments is advantageously configured to move between a closed position shown in FIG. 1 and an open position in FIG. 2, the open position being defined by enabling access to a functional/storage device contained within the base 140. This functional/storage device can take many forms, several of which are described below like a fire pit and an ice bucket. Regardless, the tabletop 120 is moved in such a manner that the tabletop surface remains in a substantially horizontal orientation both at and between the open and closed positions. As such, the tabletop 120 may continue to be used even when moved to the open position, and the space-efficiency and functionality of the functional/storage device can be simultaneously used with the table function of the outdoor patio table 100.

As shown in FIGS. 1 through 3, the base 140 includes a base panel 142, sidewalls 144, legs 146, feet 148, and a top panel 220. In the illustrated embodiment, the base 140 includes base panel 142 for enclosing the bottom portion of the base 140. The base panel 142 includes an upper surface 143, a lower surface 145, a thickness that defines edges, and a perimeter. It is contemplated that, when the fire bowl table 100 is in its upright position (as shown in the illustrations), the base panel will be parallel with the ground. A plurality of sidewalls 144 extends upwardly from the perimeter of the base panel 142 and define sides of the base 140. The sidewalls 144 and the base panel 142 (along with the top panel) collectively enclose an interior which includes a contained space 280 as set forth in further detail below. It will be appreciated that some of all of the base panel 142 and the sidewalls 144 may include vents or may otherwise be discontinuous in some embodiments (e.g., not just solid panels), but the contained space 280 remains largely enclosed even in these alternatives. Furthermore, the sidewalls 144 may be defined by one or more walls of varying shape and size (e.g., a round sidewall is possible in some embodiments). The base 140 and the tabletop 120 and their components are formed from a weather-resistant material or materials, such as aluminum in one embodiment (other metals, plastics, resins, wood materials (such as teak or treated wood configured to resist water damage) can be used). Therefore, the fire bowl table 100 is properly configured for use as outdoor furniture.

In the illustrated embodiment, the base 140 includes legs 146 extending along the sidewalls 144, and feet 148 that are attached to the base 140. The legs 146 also extend downward from the base 140 to contact the feet 148. The height of the tabletop 120 may be determined by the length of the legs 146. For instance, if a higher tabletop 120 is desired, the legs 146 may be configured as longer than if a shorter tabletop 120 is desired. The legs 146 come into direct contact with the ground at their bottom ends thereof in embodiments where the feet 148 are omitted. In other embodiments, the lower surface 145 of the base panel 142 may contact the ground directly and rest on the ground. In such an embodiment, the base panel 142 provides a secure base for supporting the weight of the fire bowl table 100.

The feet 148 have an upper surface, a lower surface, a thickness that defines edges, and a perimeter. The lower surface of the feet 148 is in direct contact with the ground and provides a secure base for supporting the weight of the fire bowl table 100. The bottom surface of the feet 148 has more area than the bottom of the legs 146, thus providing better stability in soft earth or other soft ground that the fire bowl table 100 may be placed on.

In another alternative embodiment (not shown), the legs 146 may be omitted, and the upper surface of the feet 148 may then be operatively attached to the lower surface 145 of the base panel 142. The thickness of the feet 148 keeps the base panel 142 from coming into direct contact with the ground in such an aspect. Indeed, regardless of the particular configuration of the elements of the base 140, the base 140 is configured to support the tabletop 120 in a stable manner, even when the tabletop 120 moves between the open and closed positions.

With additional reference to FIGS. 2 and 3, additional features of the fire bowl table 100 are shown, with the tabletop 120 in an open position. The tabletop 120 is configured to slide horizontally across the base 140 between a generally cantilevered position relative to the base 140 (the open position) and the closed position directly on top of and covering the base 140. Sliding the tabletop 120 to the open position reveals or exposes the top panel 220 of the base 140. The top panel 220 includes an upper surface 221, a lower surface 223, a thickness that defines edges, and a perimeter. The base panel 142, sidewalls 144, and top panel 220 define the enclosed interior referenced initially above and also described as the contained space 280. The upper surface 143 of the base panel 142 forms the bottom of the contained space 280, and the lower surface 223 of the top panel 220 forms the top of the contained space 280.

The top panel 220 also includes one or more apertures that extend through the thickness of the top panel 220 from the upper surface 221 to the lower surface 223. The apertures define shoulders for sensors and/or the functional/storage devices to be retained upon relative to the top panel 220. For example, the functional/storage device of this embodiment is a fire bowl 240 that engages, and is received by, an aperture 281 of the top panel 220. As illustrated in FIG. 3, the fire bowl 240 extends through the aperture 281 and into the contained space 280. In one embodiment, the fire bowl 240 is received by the aperture 281 such that a peripheral lip 283 of the fire bowl 240 is flush with the upper surface 221 of the top panel 220. This flush reception of the fire bowl 240 into the aperture 281 of the top panel 220 allows the tabletop 120 to slide horizontally across the upper surface 221 of the top panel 220 without coming into contact with the fire bowl 240, or otherwise being occluded from movement between the open and closed positions.

The tabletop 120 is slidably attached to the top panel 220 such that the tabletop 120 may be moved horizontally while remaining attached to and parallel with the top panel 220. To this end, the tabletop 120 may be slidably attached to the top panel 220 using any suitable method. In one embodiment, a movement assembly, referred to hereinafter as a slide rail assembly 285, is used to slidably attach the tabletop 120 to the top panel 220. Other methods and devices for securing these elements together are possible, at least one alternative of which is described below.

A suitable slide rail assembly 285 includes a first portion, referred to hereinafter as a first rail 287, and a second portion, referred to hereinafter as a second rail 289. In an embodiment of slide rail assembly 285, second rail 289 is secured to tabletop 120, first rail 287 is secured to table 100, and first rail 287 is slidably attached to second rail 289. In this embodiment, second rail 289 is slidably received into the first rail 287 such that the second rail 289 telescopes out of the first rail 287. The second rail 289 is locked into the first rail 287, so as to not allow the first rail 287 and the second rail 289 to disengage, and thus, not allow the tabletop 120 to become separated from the top panel 220 and the base 140. As illustrated in FIGS. 2 and 3, when the tabletop 120 is slid into the open position, part of the tabletop 120 cantilevers past the perimeter of the top panel 220. When the tabletop 120 is moved to the closed position, tabletop 120 un-cantilevers or moves back from the open position to the closed position. However, in all parts of this sliding movement, which is along a linear path as a result of the telescoping motion of the first and second rails 287, 289, the tabletop 120 favorably maintains the substantially horizontal orientation such that items stored on the tabletop surface can remain on the tabletop surface, even during reconfiguration of the fire bowl table 100.

It will be understood that the first and second rails 287, 289 are coupled to one another and configured so as to bear and transfer the cantilever loading that will be applied by the weight of the tabletop 120 and a reasonable amount of items when placed on the tabletop surface. To this end, the base 140 is configured to support the entirety of the table 100 without tipping over even when these cantilever loads are applied through the first and second rails 287, 289. Of course, additional elements like fold-out secondary support legs or a separate support leg can be used with the cantilevered portion of the tabletop 120 in other embodiments without departing from the scope of the invention. Such alternatives may be desirable when very heavy objects are to be maintained on the tabletop surface while using the fire bowl table 100 in the open position.

To address any concerns with cantilever loads and tipping over, the tabletop 120 in other embodiments such as those described below may be divided into two bifurcated segments instead of a single, unitary member. The two segments may be approximately equal in size, and oppose each other on one edge as they are slidably attached to the top panel 220. The two segments of the tabletop 120 may slide into an open position in opposite directions from each other, revealing the top panel 220 and the fire bowl 240. In this configuration, and when in an open position, a part of each segment of the tabletop 120 is cantilevered past the perimeter of the top panel 220 in diametrically opposing directions. This embodiment provides the advantage of allowing the weight of the two segments of the tabletop 120 to offset each other when cantilevered in the open position, thus assuring additional stability to the fire bowl table 100 while also dividing space usage and table access to all sides of the functioning fire pit. However, the segments would still define a unitary arrangement of the tabletop surface when in the closed position, in these embodiments.

The contained space 280 includes a fuel tank 300 that is operatively coupled to a burner element 320 positioned in the fire bowl 240. Liquid or gaseous fuel flows from the fuel tank 300 to the burner element 320 via supply line 330, where it is ignited to produce flames. In other embodiments (not shown), the fuel tank 300 and the burner element 320 may be absent, and a traditional solid fuel, such as wood or coal, may be placed in an empty fire bowl 240 and ignited to produce flames. In this regard, any type of known fire pit and combustible fuel may be used in conjunction with the fire bowl table 100 of the present invention, so long as it can be contained within the base 140.

The fuel tank 300 is optionally further operatively coupled to a switch 260 that, when operated, automatically opens or closes an inline valve 340 situated in the supply line 330 between the fuel tank 300 and the burner element 320. For instance, when the switch 260 is activated, the inline valve 340 closes, blocking or stopping the flow of fuel from the fuel tank 300 to the burner element 320 via the supply line 330. Conversely, when the switch 260 is not activated, the inline valve 340 remains open, allowing fuel to flow freely through the supply line 330.

Likewise, the fuel tank 300 is operatively coupled as schematically shown in FIGS. 1 through 3 to a control panel 350 located along one of the sidewalls 144. Although this schematic connection is shown in FIG. 3, it will be understood that such a control panel 350 should be readily accessible when the tabletop 120 is moved to the open position, which means the control panel 350 is located along one of the sidewalls 144 which the tabletop 120 does not cantilever over when in the open position (e.g., the positioning shown in FIGS. 1 and 2). The control panel 350 includes fuel control dials and/or starter switches that also effectively control combustion and supply of fuel into the fire bowl 240, as is customary with propane-style grills and fire pits. Moreover, the specific interface elements and positioning of the control panel 350 may be modified in other embodiments without departing from the scope of the invention.

In an exemplary embodiment, the switch 260 will be received by, and secured within, an aperture 261 of the top panel 220. The switch 260 will be received by the aperture 261 such that when the tabletop 120 is slid into the closed position, the tabletop 120 will come into contact or abut the switch 260 before the tabletop 120 slides over the fire bowl 240. When the tabletop 120 comes into contact with the switch 260, the contact will activate the switch 260, thereby closing the valve 340 and interrupting the flow of fuel to the burner element 320. With fuel no longer flowing to the burner element 320, combustion at the burner element will cease, thus ensuring the tabletop 120 will not come into contact with flames from the burner element 320. In an embodiment of switch 260, a pressure switch is operatively connected to the fuel supply line and configured to block the supply of fuel to the burner element 320 when tabletop 120 is in the closed position. In another embodiment of switch 260, an optical sensor may sense when the tabletop 120 is in the closed position through optics (e.g., ambient light detection or otherwise). To this end, the switch 260 may be provided by any type of pressure, optical, or other proximity sensor which is capable of determining when the tabletop 120 is in the closed position and when it is in the open position.

Access to the contained space 280 may be facilitated by one or more doors (not shown) in one of the sidewalls 144. Alternatively, one or more of the sidewalls 144 may be configured as removable from the base 140 to allow access to the contained space 280, such as for tank maintenance or replacement.

Figure 4:
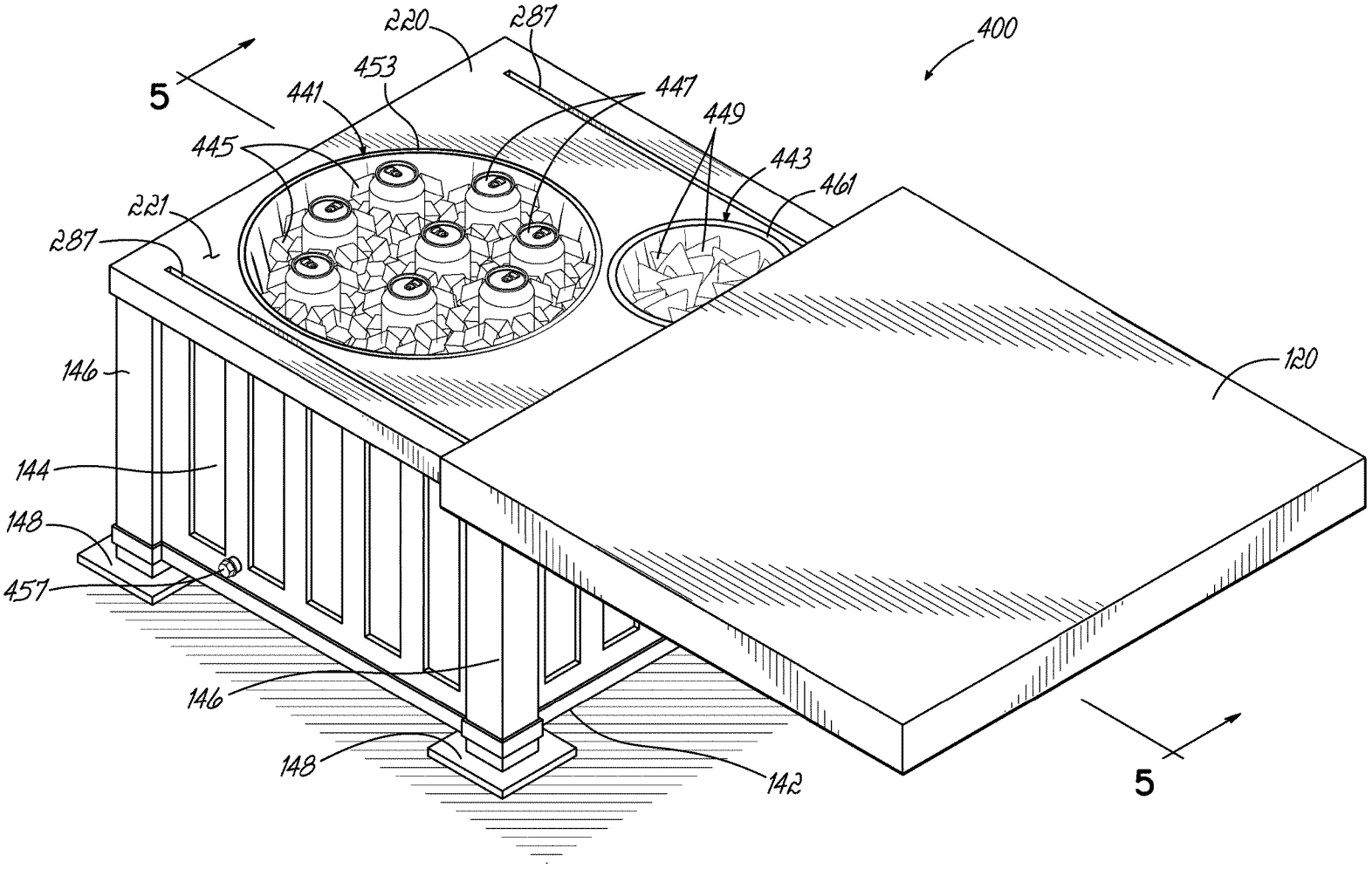
FIG. 4 is a perspective view of an outdoor patio table in accordance with another embodiment of the invention, with a tabletop of the table in an open position to reveal an ice bucket and a bowl which may be used to hold foodstuffs or other service items while the tabletop continues to be used in the substantially horizontal orientation.
Figure 5:
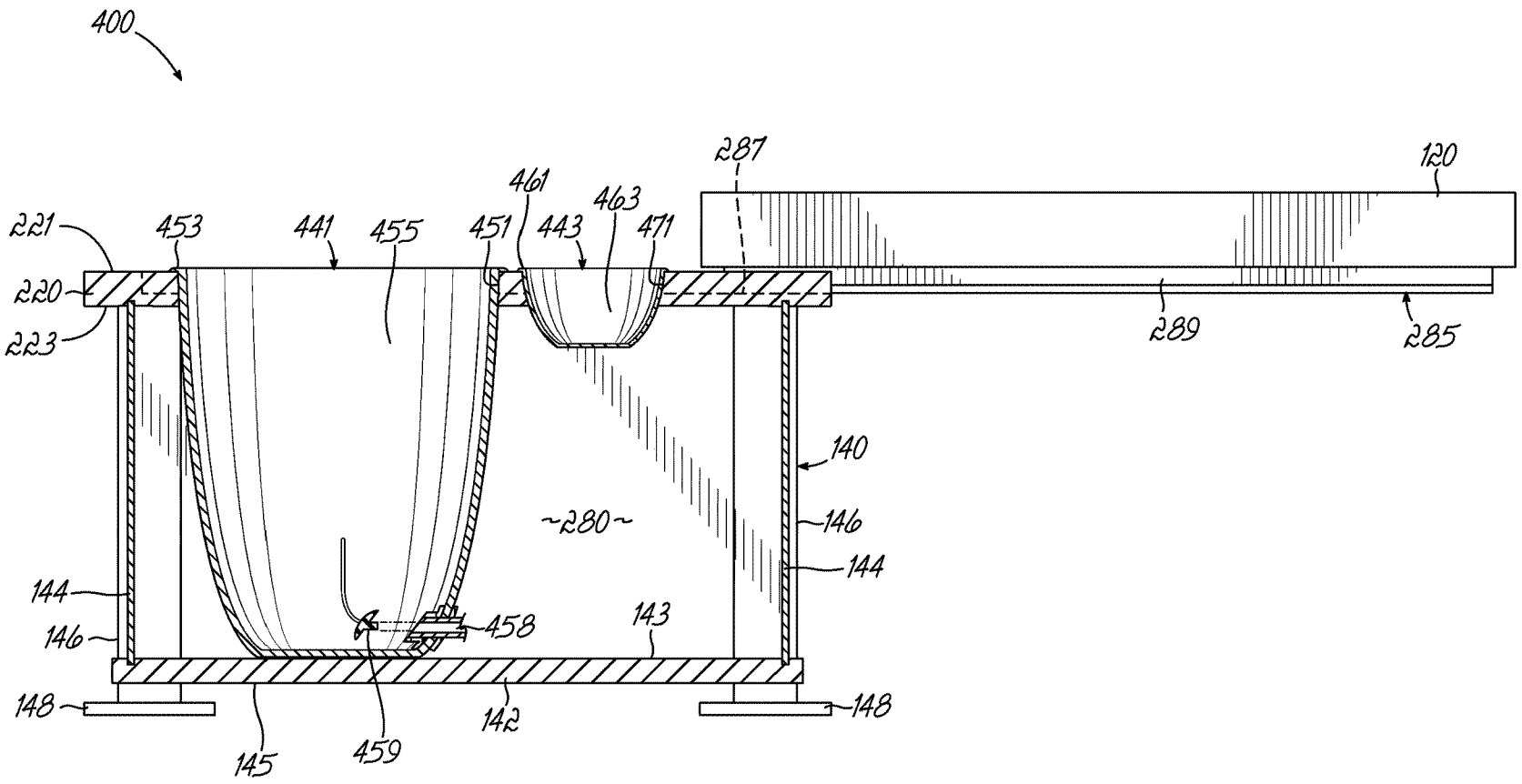
FIG. 5 is a cross-sectional front view of the table of FIG. 4, taken along line 5-5, to reveal additional internal features of the ice bucket and table.

Referring now to FIGS. 4 and 5, another embodiment of an outdoor patio table 400 in accordance with the invention is shown. Many of the elements of this embodiment are identical or substantially similar to those described with reference to the previous embodiment above (including a base 140 with sidewalls 144, legs 146, and feet 148), and such elements have been applied with the same reference numbers without substantive duplication of description below. To this end, the following description of the outdoor patio table 400 of this embodiment focuses on the distinctions of this embodiment.

The outdoor patio table 400 of this embodiment is referred to as a storage bowl table 400, and it includes an ice bucket 441 and a snack bowl 443, rather than the fire bowl 240 of the previously described embodiment shown in FIG. 1 through 3. Ice bucket 441 is configured to selectively hold a plurality of beverages 447 on an amount of ice 445 to provide chilled drinks to a party guest or any other user of storage bowl table 400. Similarly, snack bowl 443 is configured to selectively hold an amount of snacks 449, such as chips or peanuts, to provide snacks to a party guest or a user of storage bowl table 400. It will be appreciated that other service items may also be stored in either of the ice bucket 441 and the snack bowl 443 (and furthermore, more than one snack bowl 443 may be provided as well depending on the configuration of the top panel 220 and the base 140).

As shown in FIGS. 4 and 5, ice bucket 441 is removably disposed through an aperture 451 defined by top panel 220 of storage bowl table 400. A lip 453 on ice bucket 441 prevents ice bucket 441 from plunging entirely through top panel 220 and acts to firmly hold ice bucket 441 in place in storage bowl table 400. An upwardly opening recess 455 defined by ice bucket 441 is presented to the user when the tabletop 120 is in the open position. The user is free to reach into an interior of the ice bucket 441 via the recess 455 and take one of the cold beverages 447. When the owner or user of storage bowl table 400 wishes to drain the melted ice 445 from the interior, the user actuates a drain 457, which opens a channel or drain line 458 from the interior of the ice bucket 441 to the exterior of table 400 to expel the melted ice 445. In an embodiment of storage bowl table 400, the user may actuate a stopper 459 located in the interior and normally engaged with an inner end of the drain line 458 to open fluid communication between the interior of ice bucket 441 and the drain line 458 to remove fluid from the ice bucket 441. Of course, the drain line 458 may be omitted in other embodiments where the ice bucket 441 is instead configured to be temporarily removed by lifting out of the base 140 to dump melted ice, or for cleaning of the ice bucket 441.

Snack bowl 443 is similar in most respects to ice bucket 441. Snack bowl 443 sits in an aperture 471 defined by top panel 220 and is prevented from plunging entirely through top panel 220 by way of a lip 461. Snack bowl 443 includes a recess 463 for accessing an interior which is sized smaller and shallower than the interior of ice bucket 441. Note that while FIG. 5 is taken along the section line 5-5, the snack bowl 443 is shown in a schematic centralized cross-section so that the relative size and features of this element may be understood as compared to the ice bucket 441 in this embodiment. Thus, the cross-sectional view is to be deemed as schematic or representative only. In any event, when the functional/storage device is defined by a plurality of bowls engaging with a plurality of apertures in the top panel 220, the plurality of bowls may define different sizes for storing different items as set forth above.

While ice bucket 441 and snack bowl 443 are shown with a particular size and shape, no limitation should be read into the embodiment of either ice bucket 441 or snack bowl 443 or storage bowl table 400 in general from the illustrated embodiment shown in FIGS. 4 and 5. A bowl may be provided which includes a divider for keeping different kind of snacks separate, or a warming bowl, such as a crock-pot style device, for keeping dips or meats warm. In this regard, multiple types of functional/storage devices may be retained at the top panel 220 of these embodiments and accessed via movement of the tabletop 120 between the open and closed positions.

Now with reference to FIGS. 6 through 9, another embodiment of an outdoor patio table 500 in accordance with the invention is shown. Many of the elements of this embodiment are identical or substantially similar to those described with reference to the previous embodiments above (including a base 140 with sidewalls 144, legs 146, and feet 148, as well as a fire bowl 240 with a burner element 320 connected to a fuel tank 300 via a supply line 330), and such elements have been applied with the same reference numbers without substantive duplication of description below. To this end, the following description of the outdoor patio table 500 of this embodiment focuses on the distinctions of this embodiment.

Figure 6:
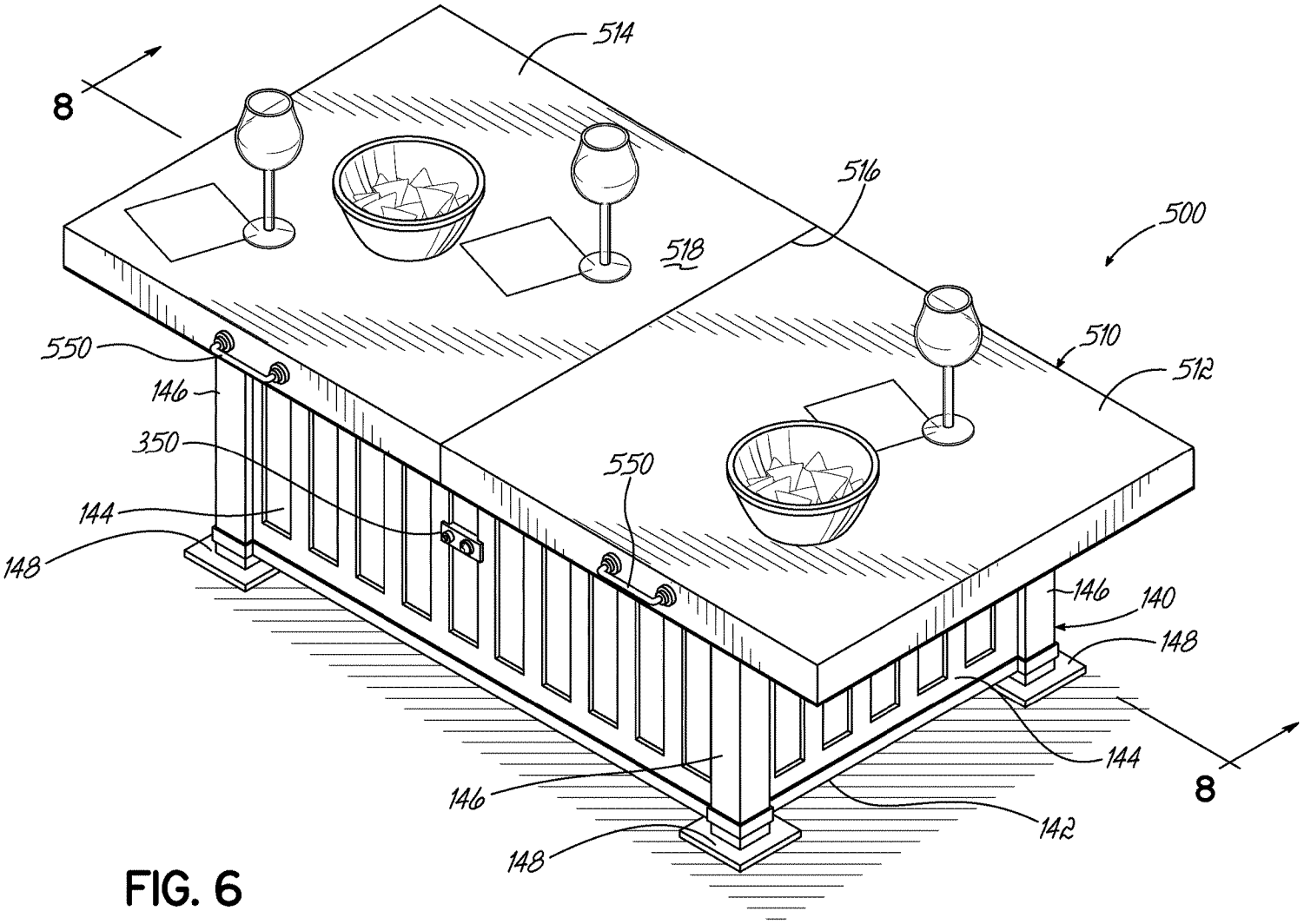
FIG. 6 is a perspective view of an outdoor patio table in accordance with yet another embodiment of the invention showing a bifurcated tabletop of the table in a closed position.

The outdoor patio table 500 of this embodiment is also referred to as a fire bowl table 500 in view of the inclusion of a fire pit-like fire bowl 240 which may be revealed by moving a bifurcated tabletop 510 between open and closed positions. The bifurcated tabletop 510 includes a first tabletop segment 512 and a second tabletop segment 514 which are configured to abut one another at a seam 516 in the center of the fire bowl table 500 when the tabletop 510 is in the closed position as shown in FIG. 6. In this closed position, the tabletop 510 defines a generally unitary tabletop surface 518 for supporting drinks, bowls, and other service items as shown, and this tabletop surface 518 is in a substantially horizontal orientation. Therefore, the fire bowl table 500 may be used in this configuration as a table, just like any ordinary patio table or similar furniture.

In the embodiment illustrated, the tabletop 510 is defined by a weather-resistant material such as aluminum, which is configured to withstand environmental conditions of all varieties which may be encountered when using outdoor furniture. Additionally, the solid aluminum material can snuff out any remaining fire in the fire bowl 240 when closed, while dissipating any residual heat by conduction rapidly out of the fire bowl table 500. The seam 516 at the abutment of the tabletop segments 512, 514 may be provided with a seal (not shown) or the like to avoid allowing rainwater or any other contaminants from leaking down into the fire bowl 240 while the tabletop 510 is in the closed position. The tabletop 510 is shown as being formed with a hollow construction underneath the tabletop surface 518, but the tabletop 510 may be formed from a solid construction as well. Of course, alternative construction materials and configurations are possible and within the scope of this invention.

Figure 7:
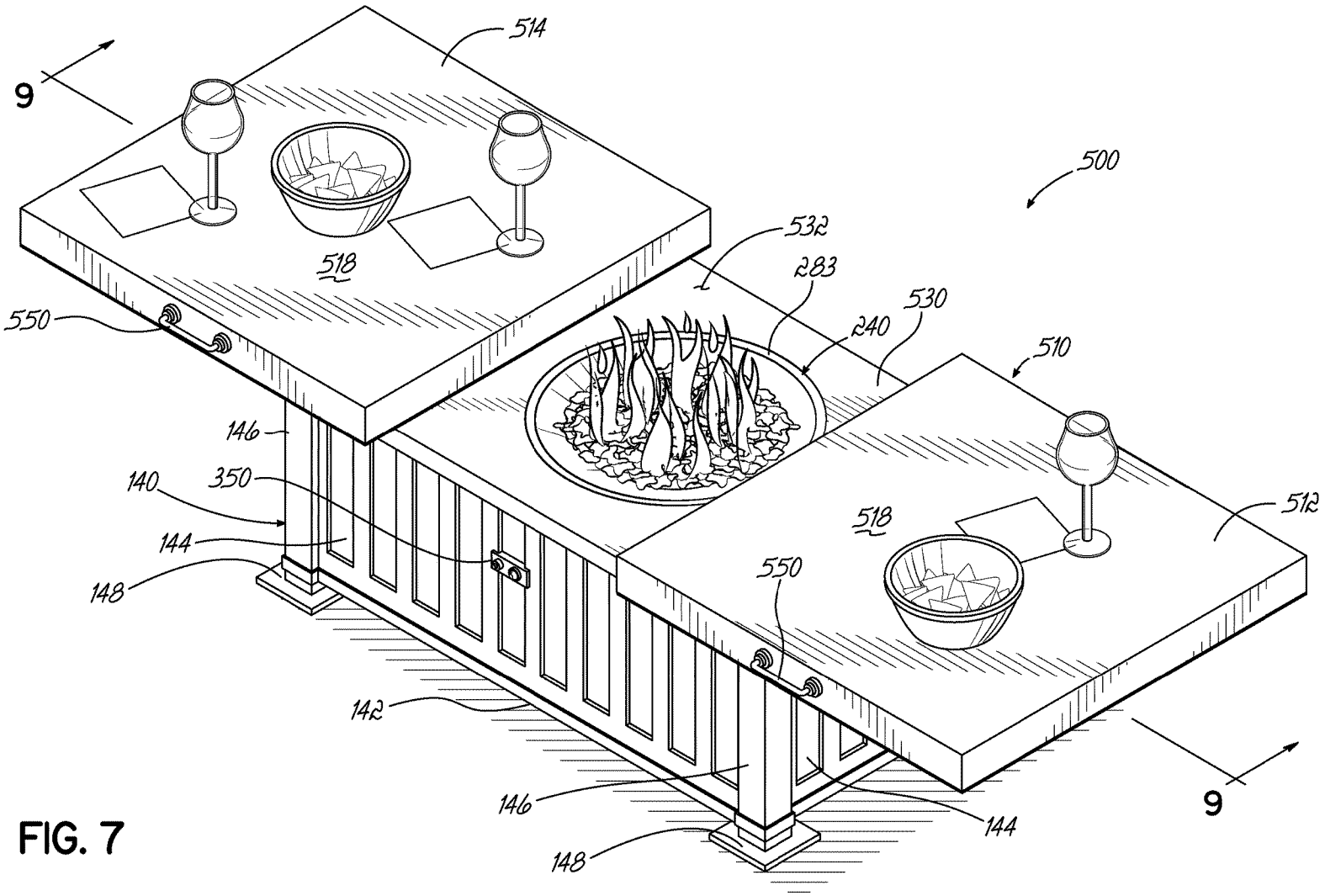
FIG. 7 is a perspective view of the table of FIG. 6, with the bifurcated tabletop moved to an open position to reveal a fire pit located within a base of the table.

When it is desired to use the fire bowl table 500 as a fire pit, the tabletop 510 can be moved to the open position as shown in FIG. 7. As revealed in this view, the base 140 of the fire bowl table 500 is the same as in previous embodiments, except for a different top panel 530 being provided. This embodiment of the top panel 530 is coupled differently to the first and second tabletop segments 512, 514 (e.g., there is no slide rail assembly 285 in this embodiment). The top panel 530 does include an upper surface 532 facing towards the tabletop 510, a lower surface 534 facing towards the enclosed interior of the base 140 at the contained space 280, and apertures 261, 281 configured as described above for a switch 260 or sensor and for the fire bowl 240. These features of the top panel 530 function in much the same way as described above, and as such, duplicative description is not provided here.

Returning to the coupling of the elements, this embodiment of the fire bowl table 500 includes a pivot linkage assembly 540 connecting the first and second tabletop segments 512, 514 to the top panel 530, and/or to the base 140 adjacent the top panel 530. More specifically, the pivot linkage assembly 540 of this embodiment includes two first pivot bars 542 connected to each lateral side of the top panel 530 and the first tabletop segment 512 (four total first pivot bars 542, although only two of these are visible in the schematic cross-sectional view of FIGS. 8 and 9. The pivot linkage assembly 540 also includes two second pivot bars 544 connected to each lateral side of the top panel 530 and the second tabletop segment 514. As will be readily understood from the Figures, each of the first pivot bars 542 and each of the second pivot bars 544 is connected at one end defined by an upper pivot point 546 to the corresponding tabletop segment 512, 514, and also connected at the other end defined by a lower pivot point 548 to the side of the top panel 530 (or the sidewall 144 depending on the specific arrangement of elements). Collectively, these first pivot bars 542 along with the top panel 530 and the first tabletop segment 512 define a four-bar linkage type arrangement which allows for movement of the first tabletop segment 512 between the closed position of FIG. 8 and the open position of FIG. 9. Likewise, the second pivot bars 544 along with the top panel 530 and the second tabletop segment 514 collectively define another four-bar linkage type arrangement which allows for movement of the second tabletop segment 514 between the open and closed positions. This movement of the tabletop segments 512, 514 is along an arc-shaped path defined by rotation of the plurality of pivot bars about the lower pivot points 548, which are stationary like the base 140.

Figure 8:
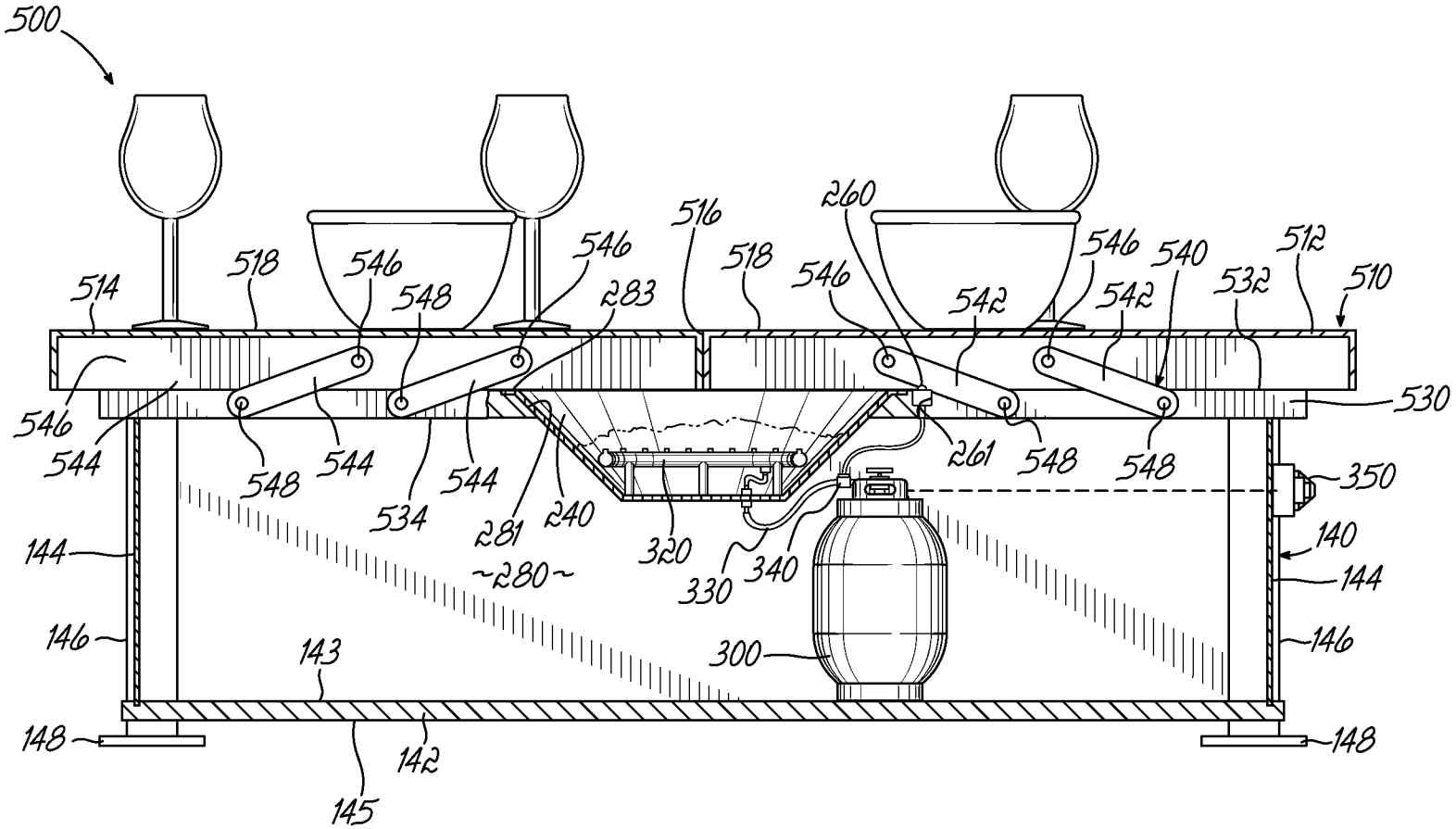
FIG. 8 is a cross-sectional side view of the table of FIG. 6, taken along line 8-8 in FIG. 6, so as to reveal internal components of the table and the pivoting linkage mechanism used to move the tabletop segments between the closed position and the open position while maintaining the tabletop segments in a substantially horizontal orientation.
Figure 9:
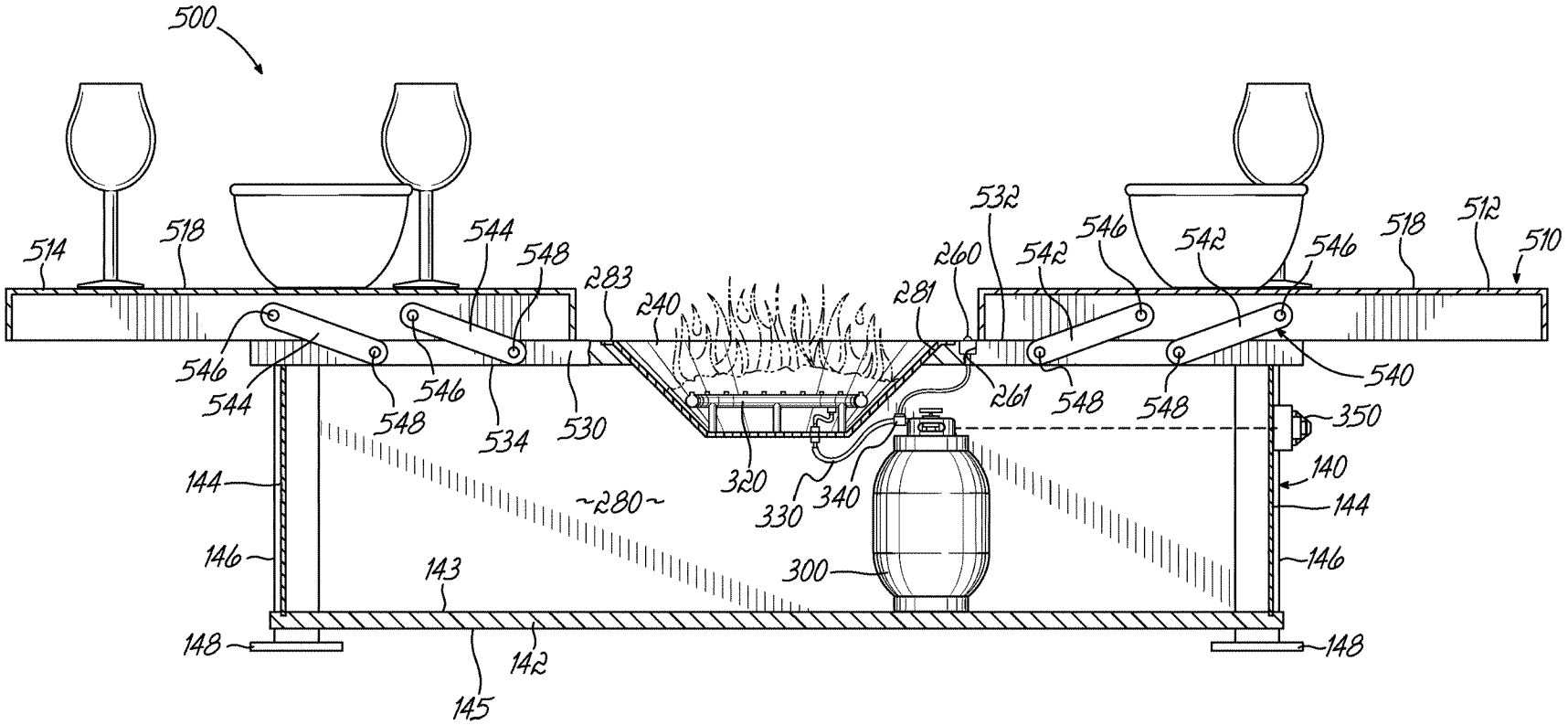
FIG. 9 is a cross-sectional side view of the table of FIG. 7, taken along line 9-9 in FIG. 7, so as to reveal internal components of the table and the pivoting linkage mechanism used to move the tabletop segments between the closed position and the open position while maintaining the tabletop segments in a substantially horizontal orientation.

The entirety of the pivot linkage assembly 540 is shown in FIGS. 8 and 9 for clarity, even though the bottom ends of the pivot bars 542, 544 would be connected to the outermost surface of the top panel 530 in this embodiment. Alternatively, the first and second pivot bars 542, 544 could be located in slots formed in the top panel 530 of other embodiments or connected to an interior surface of the top panel 530 or sidewalls 144 without departing from the scope of this invention. So long as the pivot linkage assembly 540 assures the advantageous movement of the tabletop 510 between the open and closed positions as set forth in detail below, the specific positioning of these elements connecting parts of the fire bowl table 500 together is not critical. Additionally, even further alternatives to the sliding engagement of slide rail assembly 285 and the pivoting engagement of the pivot linkage assembly 540 may be used in other embodiments.

The pivot linkage assembly 540 and other versions of a movement assembly, such as the slide rail assembly 285 above, are configured such that the tabletop is non-removably coupled to the top panel of the base. To this end, unlike some conventional designs where the tabletop or a lid must be separately managed, the tabletops in the embodiments of this invention cannot be removed without complete disassembly of the movement assembly. This arrangement allows for the functional benefits to be achieved as described herein, including continuous use of the tabletop surface regardless of whether the tabletop is in the open or closed position, or moving therebetween.

The tabletop 510 further includes a set of handles 550 in this embodiment. The handles 550 are welded, adhered, or otherwise secured in a known manner to opposite peripheral or side edges at the periphery of the tabletop segments 512, 514. Thus, a user may grasp these handles 550 and pull or push on the tabletop segments 512, 514 to cause pivotal movement of the first and second pivot bars 542, 544 and corresponding movement of the tabletop 510 between the open and closed positions. The handles 550 may be repositioned or omitted in other embodiments consistent with the scope of this disclosure, so long as they continue to assist with controlling movement of the tabletop segments 512, 514.

Advantageously, the four-bar linkage arrangement defined by the first and second pivot bars 542, 544 enables movement of the first and second tabletop segments 512, 514 in such a manner that the tabletop surface 518 is in a substantially horizontal orientation at each of the open and closed positions, as shown most clearly in FIGS. 8 and 9. Even moreso, this substantially horizontal orientation of the tabletop segments 512, 514 is maintained throughout the movement between the open and closed positions as a result of how the pivot linkage assembly 540 limits relative movement of the tabletop 510 relative to the top panel 530. As such, any drinks, bowls, or other service items positioned on the tabletop surface 518 do not need to be removed while converting the fire bowl table 500 between the different use configurations shown in this embodiment. The tabletop 510 is therefore useable in multiple positions of the fire bowl table 500.

Likewise, as set forth above, the entirety of the tabletop surface 518 remains useable when the fire pit functionality is available, with portions of the tabletop surface 518 accessible on both sides of the fire bowl table 500 so that all users can still have tabletop space. Most of this tabletop surface 518 is spaced well apart from the edge of the fire bowl 240, so problems with warming up drinks and combusting materials are minimized if not eliminated with this design. Although the pivot linkage assembly 540 is configured to transfer all cantilever loads of the tabletop segments 512, 514 in the open position, and the base 140 is configured to bear such cantilever loads without tipping over, the bifurcation of the tabletop 510 and cantilevering in opposite directions further enhances the stability and usefulness of the table 500 in the outdoor patio or deck setting.

Thus, in all embodiments of the outdoor patio table 100, 400, 500 described herein, the tabletop and its tabletop surface remain fully functional and useable regardless of whether the functional/storage device (fire pit, ice bucket, and/or otherwise) in the base 140 is being used as well. As such, the outdoor patio table provides several advantages over conventional designs such as by solving many of the problems outlined above in the Background section. Accordingly, the desires for space-efficiency and functionality in the outdoor furniture setting of decks and patios can be achieved when using the designs described herein.

The device is typically—but not necessarily—configured as a table, such as a patio or coffee table. The specific height of the table may vary in different embodiments without departing from the scope of this disclosure. In other embodiments, the device may be configured as some other type of outdoor furniture such as, but not limited to, an ottoman, or an end table. Additionally, the device may be incorporated into a piece of furniture, such as a couch, a love seat, a bar, a counter, etc. To this end, the concepts of maintaining a "tabletop" or horizontal surface for use and moving it so that a functional/storage device can simultaneously be used is applicable in multiple contexts, these different contexts being summarized herein by use of the term "table" in the following claims.

While the present invention has been illustrated by a description of exemplary embodiments and while these embodiments have been described in some detail, it is not the intention of the Applicant to restrict or in any way limit the scope of the appended claims to such detail. Additional advantages and modifications will readily appear to those skilled in the art. The various features of the disclosure may be used alone or in any combination depending on the needs and preferences of the user. Further, features that are described and/or illustrated with respect to one embodiment may be used in the same way or in a similar way in one or more other embodiments and/or in combination with or instead of the features of the other embodiments. This has been a description of the present invention, along with the preferred methods of practicing the present invention as currently known. However, the invention itself should only be defined by the appended claims.

What is claimed is:

1. A multi-function outdoor patio table, comprising:

a base including a top panel, a base panel, and sidewalls extending between the top panel and the base panel, the base surrounding a contained space, and the top panel including an aperture communicating with the contained space;

a tabletop coupled to the base proximate the top panel by a movement assembly, wherein the tabletop is moveable between an open position and a closed position relative to the base, and the tabletop being made of a weather resistant material;

a functional/storage device which is revealed for access and use when the tabletop is moved to the open position, wherein the functional/storage device engages with the aperture and extends into the contained space, wherein the functional/storage device further comprises a bowl including a peripheral lip engaging the top panel of the base such that the bowl extends into the contained space from the aperture in the top panel;

a burner element disposed in the bowl and configured to ignite fuel therein; and a supply line adapted to provide the fuel to the burner element from a tank stored within the contained space, the tabletop defining a tabletop surface for supporting various items, and the movement assembly is arranged such that the tabletop surface is disposed in a substantially horizontal orientation at both of the open and closed positions, thereby enabling support of the various items regardless of table configuration.

2. The outdoor patio table of claim 1, wherein the movement assembly maintains the substantially horizontal orientation of the tabletop surface during movement of the tabletop between the open and closed positions.

3. The outdoor patio table of claim 2, wherein the movement assembly further comprises:

a pivot linkage assembly including a plurality of pivot bars coupled to the tabletop and to the base adjacent the top panel, wherein rotation of the pivot bars causes the tabletop to move along an arc-shaped path between the open and closed positions.

4. The outdoor patio table of claim 3, wherein each of the plurality of pivot bars defines an upper pivot point at a coupling to the tabletop and a lower pivot point at a coupling to the top panel, thereby enabling the tabletop to remain in the substantially horizontal orientation during movement along the arc-shaped path.

5. The outdoor patio table of claim 2, wherein the movement assembly further comprises:

a slide rail assembly including a first rail coupled to the top panel of the base and also including a second rail coupled to the tabletop, wherein sliding movement of the tabletop relative to the top panel at the first and second rails causes the tabletop to move along a linear path between the open and closed positions.

6. The outdoor patio table of claim 1, wherein the tabletop is defined by a single, unitary member coupled by the movement assembly to the base, and the tabletop is cantilevered at least partially beyond at least one of the sidewalls of the base when the tabletop is moved to the open position.

7. The outdoor patio table of claim 1, wherein the tabletop is bifurcated into a first tabletop segment and a second tabletop segment, the first and second tabletop segments abutting in the closed position, and the first and second tabletop segments being cantilevered in opposite directions at least partially beyond the sidewalls of the base when the tabletop is moved to the open position.

8. The outdoor patio table of claim 7, wherein the movement assembly couples each of the first and second tabletop segments separately to the top panel of the base.

9. The outdoor patio table of claim 7, wherein the first and second tabletop segments define a unitary arrangement of the tabletop surface in the closed position and define a bifurcated arrangement separating portions of the tabletop surface from one another in the open position.

10. The outdoor patio table of claim 1, wherein the tabletop is formed from aluminum so as to be weather resistant and fire resistant.

11. The outdoor patio table of claim 1, wherein the tabletop further comprises one or more handles located along peripheral edges and which are configured to assist with controlling movement of the tabletop between the open and closed positions.

12. The outdoor patio table of claim 1, wherein the tabletop is non-removably coupled to the top panel by the movement assembly.

13. The outdoor patio table of claim 1, further comprising:

a control panel positioned on one of the sidewalls of the base and operable to control fuel supply through the supply line to the burner element.

14. The outdoor patio table of claim 1, further comprising:

a switch, wherein the switch is operably connected to the supply line and wherein the switch automatically causes blocking of fuel supply to the burner element through the supply line when the tabletop is in the closed position.

15. A multi-function outdoor patio table, comprising:

a base including a top panel, a base panel, and sidewalls extending between the top panel and the base panel, the base surrounding a contained space, and the top panel including an aperture communicating with the contained space;

a tabletop coupled to the base proximate the top panel by a movement assembly, wherein the tabletop is moveable between an open position and a closed position relative to the base, and the tabletop being at least partially made of a weather resistant material; and a functional/storage device which is revealed for access and use when the tabletop is moved to the open position, wherein the functional/storage device engages with the aperture and extends into the contained space, wherein the functional/storage device further comprises a bowl including a peripheral lip engaging the top panel of the base such that the bowl extends into the contained space from the aperture in the top panel, the tabletop defining a tabletop surface for supporting various items, and the movement assembly is arranged such that the tabletop surface is disposed in a substantially horizontal orientation at both of the open and closed positions, thereby enabling support of the various items regardless of table configuration, wherein the bowl defines an ice bucket for receiving ice and beverages or foodstuffs, and the ice bucket further comprises:

a drain line for facilitating a fluid communication between the bowl and a drain on the base which is communicating with an exterior outside the outdoor patio table; and a stopper for selectively opening and closing the fluid communication through the drain line from the bowl to the exterior of the table.

16. A multi-function outdoor patio table, comprising:

a base including a top panel, a base panel, and sidewalls extending between the top panel and the base panel, the base surrounding a contained space, and the top panel including an aperture communicating with the contained space;

a tabletop coupled to the base proximate the top panel by a movement assembly, wherein the tabletop is moveable between an open position and a closed position relative to the base, and the tabletop being at least partially made of a weather resistant material; and a functional/storage device which is revealed for access and use when the tabletop is moved to the open position, wherein the functional/storage device engages with the aperture and extends into the contained space, wherein the functional/storage device further comprises a bowl including a peripheral lip engaging the top panel of the base such that the bowl extends into the contained space from the aperture in the top panel, the tabletop defining a tabletop surface for supporting various items, and the movement assembly is arranged such that the tabletop surface is disposed in a substantially horizontal orientation at both of the open and closed positions, thereby enabling support of the various items regardless of table configuration, wherein the functional/storage device is defined by a plurality of bowls which removably engage with a corresponding plurality of apertures provided in the top panel of the base, the plurality of bowls defining different sizes for storing different items.

17. A multi-function outdoor patio table, comprising:

a base including a top panel, a base panel, and sidewalls extending between the top panel and the base panel, the base surrounding a contained space, and the top panel including an aperture communicating with the contained space;

a tabletop coupled to the base proximate the top panel by a movement assembly, the tabletop being moveable between an open position and a closed position relative to the base, the tabletop being formed from aluminum so as to be weather resistant and fire resistant, and wherein the tabletop is bifurcated into a first tabletop segment and a second tabletop segment, the first and second tabletop segments abutting in the closed position, and the first and second tabletop segments being cantilevered in opposite directions at least partially beyond the sidewalls of the base when the tabletop is moved to the open position;

a functional/storage device which is revealed for access and use when the tabletop is moved to the open position, wherein the functional/storage device further comprises:

a bowl including a peripheral lip engaging the top panel of the base such that the bowl extends into the contained space from the aperture in the top panel;

a burner element disposed in the bowl and configured to ignite fuel therein; and a supply line adapted to provide the fuel to the burner element from a tank stored within the contained space, the tabletop defining a tabletop surface for supporting various items, and the movement assembly is arranged such that the tabletop surface is disposed in a substantially horizontal orientation at both of the open and closed positions and also during movement of the tabletop between the open and closed positions, wherein the tabletop is non-removably coupled to the top panel by the movement assembly.

* * * * *